US010016732B2

(12) United States Patent
Goto et al.

(10) Patent No.: US 10,016,732 B2
(45) Date of Patent: Jul. 10, 2018

(54) PAINT CIRCULATION SYSTEM

(71) Applicant: HONDA MOTOR CO., LTD., Tokyo (JP)

(72) Inventors: Masaya Goto, Tokyo (JP); Eimitsu Tajima, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/910,933

(22) PCT Filed: May 13, 2015

(86) PCT No.: PCT/JP2015/063829

§ 371 (c)(1),
(2) Date: Feb. 8, 2016

(87) PCT Pub. No.: WO2015/190209

PCT Pub. Date: Dec. 17, 2015

(65) Prior Publication Data

US 2016/0184784 A1 Jun. 30, 2016

(30) Foreign Application Priority Data

Jun. 11, 2014 (JP) ..... 2014-120521

(51) Int. Cl.
*B65D 88/64* (2006.01)
*B01F 5/10* (2006.01)
(Continued)

(52) U.S. Cl.
CPC ..... *B01F 5/10* (2013.01); *B01F 15/0237* (2013.01); *B05B 5/16* (2013.01); *B05B 12/14* (2013.01);
(Continued)

(58) Field of Classification Search
CPC ..... B05B 7/12; B05B 9/0406; B05B 9/0413; B05B 9/0423; B05B 9/043;
(Continued)

(56) References Cited

U.S. PATENT DOCUMENTS 2,244,686 A * 6/1941 Garrison ..... B01J 19/0013 137/116.3
4,653,532 A * 3/1987 Powers ..... B05B 9/0406 137/563
(Continued)

FOREIGN PATENT DOCUMENTS

JP 0 795 355 A2 9/1997
JP 9-294953 11/1997
(Continued)

OTHER PUBLICATIONS

International Search Report, dated Aug. 18, 2015 (dated Aug. 18, 2015).

*Primary Examiner* — Craig Schneider
*Assistant Examiner* — Angelisa L Hicks
(74) *Attorney, Agent, or Firm* — Rankin, Hill & Clark LLP

(57) ABSTRACT

A paint circulation system includes: a main line; a branch line; a supply pump; and a pressurization device for storing pressure of the paint in a high-pressure state in which the pressure of the paint is higher than a predetermined pressure, and for applying pressure to the paint inside of the branch line in a low-pressure state in which the pressure of the paint is lower than the predetermined pressure, in which sedimentation of the paint is prevented by driving the supply pump so that the high-pressure state and the low-pressure state occur, to cause flow sending the paint inside of the branch line from a side of the painting device to a side of the main line using a pressure difference between the predetermined pressure in the low-pressure state and the pressure of the paint.

5 Claims, 6 Drawing Sheets

(51) Int. Cl.

| | |
|---|---|
| ***B05B 5/16*** | (2006.01) |
| ***B01F 15/02*** | (2006.01) |
| ***B05B 12/14*** | (2006.01) |
| *B01F 3/00* | (2006.01) |
| *B05B 13/04* | (2006.01) |

(52) U.S. Cl.
CPC . *B01F 2003/0028* (2013.01); *B01F 2215/005* (2013.01); *B05B 13/0431* (2013.01)

(58) Field of Classification Search
CPC ..... B01F 15/0237; B01F 5/10; B01F 2003/0028; B01F 2215/005
USPC ..... 137/565.35; 138/30, 31; 222/143, 148
See application file for complete search history.

(56) References Cited

U.S. PATENT DOCUMENTS

| | | | | |
|---|---|---|---|---|
| 5,277,333 | A | 1/1994 | Shimano | |
| 5,433,587 | A * | 7/1995 | Bankert | B05B 9/0406 137/563 |
| 5,915,593 | A | 6/1999 | Bancon | |
| 7,066,352 | B2 * | 6/2006 | Ono | B05C 11/1047 222/386 |
| 2013/0230661 | A1 | 9/2013 | Takebe et al. | |

FOREIGN PATENT DOCUMENTS

| | | |
|---|---|---|
| JP | 10-506844 | 7/1998 |
| JP | 2002-159907 | 6/2002 |
| JP | 2006-061839 | 3/2006 |
| JP | 2010-149019 | 7/2010 |
| JP | 2013-180290 | 9/2013 |
| WO | 92/00813 | 1/1992 |

* cited by examiner

PAINT CIRCULATION SYSTEM

TECHNICAL FIELD

The present invention relates to a paint circulation system that provides paint from a paint tank to a painting means.

BACKGROUND ART

Conventionally, in order to prevent the settling of paint occurring inside pipes in a paint circulating system, a method has been known of circulating the paint even when the painting device (painting means) is not operating. For example, Patent Document 1 is given as literature disclosing this type of paint circulating system that circulates paint. Patent Document 1 relates to a fluid circulation system including a main circulation loop, and a plurality of drops that branch from the main circulation loop and lead to application devices, and discloses a configuration that returns the fluid sent to the application device side back to the main circulation loop by way of a station pump installed in the drop.

Patent Document 1: Japanese Unexamined Patent Application, Publication No. H09-294953

DISCLOSURE OF THE INVENTION

Problems to be Solved by the Invention

There is also a method of circulating paint by providing a side line separately connecting the painting device and paint tank, and returning to the paint tank through the side line when the painting device is not operating. However, such a side line requires connecting the paint tank, which is at a most upstream side, with the painting device, which is at the most downstream side, by way of plumbing, and thus the configuration for managing the plumbing becomes large scale. In this regard, the configuration disclosed in Patent Document 1 does not require providing a side line; however, it is necessary to provide to the painting device side a drive means such as an electromagnetic shutter valve separately from the supply pump for supplying paint form the paint tank to the painting device. In the case of providing a driving means on the painting device side, since a configuration for controlling this driving means, etc. also become necessary, it leads to complication of the device configuration, and thus sufficient cost reduction is difficult. In this way, there has been margin for improvement from in a conventional paint circulation system from the viewpoint of cost reduction and space savings of the device.

The present invention has the object of providing a paint circulation system that can effectively and appropriately prevent the sedimentation of paint, as well as being able to realize a cost reduction and space savings in the device configuration.

Means for Solving the Problems

The present invention is related to a paint circulation system (e.g., the paint circulation system 1 described later) for supplying paint from a paint tank (e.g., the paint tank 12 described later) to a painting means (e.g., the painting device 20 described later), including: a loop-like main line (e.g., the main line 11 described later) in which the paint is supplied from the paint tank; a branch line (e.g., the branch line 15 described later) that branches from the main line, and is connected to the painting means; a supply pump (e.g., the supply pump 13 described later) that pressure-feeds the paint supplied to the main line to a side of the painting means; and a pressurization means (e.g., the pressurization device 30 described later) for storing pressure of the paint in a high-pressure state in which the pressure of the paint pressure fed by the supply pump is higher than a predetermined pressure, and for applying pressure to the paint inside of the branch line in a low-pressure state in which the pressure of the paint is lower than the predetermined pressure, in which sedimentation of the paint is prevented by driving the supply pump so that the high-pressure state and the low-pressure state occur, to cause flow sending the paint inside of the branch line from a side of the painting means to a side of the main line using a pressure difference in the low-pressure state.

Since it is thereby possible to cause the paint in the branch line to reverse flow to the main line side using the pressure difference between the inside of the main line and the inside of the branch line, sedimentation of paint occurring due to stagnation can be effectively prevented. In addition, since sedimentation of paint is prevented according to driving of the supply pump feeding the paint in the paint tank to the painting means side, it is unnecessary to separately provide large-scale plumbing such as that connecting the paint tank from the painting means in order to return paint to the paint tank, a configuration to control the driving means for causing paint to circulate at the painting means side or the like, and thus it is possible to realize a cost reduction and space savings in the paint circulation system that can prevent the sedimentation of paint.

It is preferable for the pressurization means to include: a main body (e.g., the main body 31 described later) having a hollow portion inside thereof; a piston (e.g., the piston 32 described later) that slides inside of the main body; a storage chamber (e.g., the storage chamber 36 described later) that is disposed at one side in an axial direction of the piston inside of the main body, and is in communication with the branch line; an accumulator (e.g., the accumulator 37 described later) that is disposed at another side in the axial direction of the piston inside of the main body, and in which gas is filled; and a pressure regulating unit (e.g., the pressure regulating valve 33 described later) that regulates pressure of the accumulator to the predetermined pressure.

Since the inside of the accumulator is thereby maintained at a predetermined pressure by the pressure regulating unit, it is possible to continuously apply the predetermined pressure to the paint flowing through the branch line via the piston, and simply configure the device configuration preventing the sedimentation of paint. In addition, since the required volume of the main body can be appropriately and simply set according to the length of the branch line, etc. due to being configured in piston type, it is possible to easily apply the appropriate configuration for preventing the sedimentation of paint in various paint circulation systems.

It is preferable to drive the supply pump so that the pressure inside of the main line varies at a predetermined time interval between the high-pressure state higher than the predetermined pressure and the low-pressure state lower than the predetermined pressure.

It is thereby possible to more effectively prevent sedimentation of paint occurring due to stagnation, since the movement of paint flowing to the painting means side and movement of reverse flowing to this flow are repeated. In addition, compared to a configuration in which the supply pump is continually driven at high pressure even in a state of the painting means not operating, since the time of driving the supply pump at low pressure lengthens, it is possible to suppress the energy consumption for driving the supply pump overall.

It is preferable for the pressurization means to be connected in communication with the branch line in a vicinity of the painting means.

Compared to a configuration in which the pressurization means is connected to the main line side of the branch line, it is thereby possible to lengthen the portion in which paint reverse flows in the branch line, and thus more effectively prevent the sedimentation of paint.

It is preferable for the paint circulation system to further include: a bypass line (e.g., the bypass line 240, bypass line 340 described later) having an end on one side connected more to a side of the painting means than a portion at which the pressurization means is connected in the branch line, and having an end on another side that is connected more to a side of the main line than a portion at which the pressurization means is connected; and a unidirectional valving means (e.g., the branch-line check valve 241 described later and the bypass-line check valve 242 described later) that permits flow in one direction to a side of the painting means in the branch line, and permits flow in one direction to a side of the main line in the bypass line, in which flow sending the paint from a side of the painting means to a side of the main line through the bypass line is produced in the low-pressure state.

Since it is thereby possible to cause flow to occur in which the paint flows through the bypass line to the main line side, the position at which the pressurization means is connected in communication to the branch line can be established freely, and thus the degree of freedom in device configuration can be improved. In addition, by connecting the end on one side of the bypass line at the vicinity of the painting means, it is possible to lengthen the portion in which paint flows in the branch line during reverse flow generation by the pressurization means, and thus the sedimentation of paint can be prevented more effectively. In addition, by providing the unidirectional valving means, it is possible to prevent the influx of paint to the bypass line when sending paint to the painting means side. Furthermore, since it is also possible to prevent flow trying to reverse flow through the branch line without passing the bypass line during flow generation by the pressurization means, it is possible to reliably return paint to the main line side through the bypass line.

Effects of the Invention

According to the paint circulation system of the present invention, it is possible to effectively and appropriately prevent the sedimentation of paint, as well as being able to realize a cost reduction and space savings in the device configuration.

PREFERRED MODE FOR CARRYING OUT THE INVENTION

Figure 1:
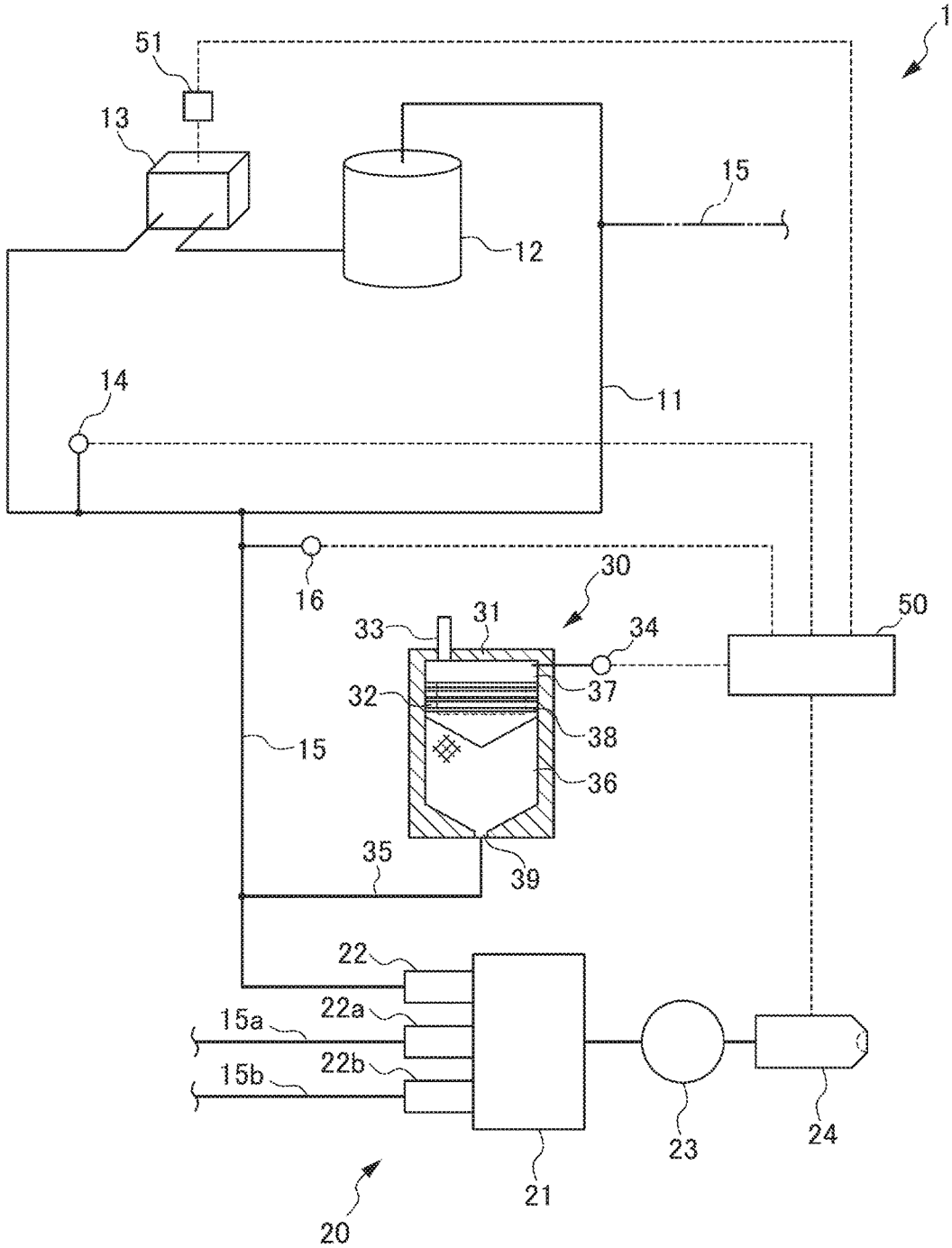
FIG. 1 is a view schematically showing a paint circulation system of a first embodiment.

Hereinafter, each preferred embodiment of a paint circulation system according to the present invention will be explained while referencing the drawings. FIG. 1 is a view schematically showing a paint circulation system 1 of a first embodiment. It is a view schematically showing the paint circulation system 1 in a state in which a piston 32 of a pressurization device 30 is applying pressure. It should be noted that "line" in the present disclosure is an abbreviation for a line that enables fluid communication such as a channel, path and pipeline.

As shown in FIG. 1, the paint circulation system 1 of the first embodiment includes a main line 11, paint tank 12, supply pump 13, main-line pressure sensor 14, branch line 15, branch-line pressure sensor 16, painting device 20 as a painting means, pressurization device 30 and a pressurization means, and a control device 50.

The main line 11 is plumbing in which paint flows, and is configured in a ring shape. The paint tank 12, supply pump 13 and main-line pressure sensor 14 are arranged in the main line 11.

The paint tank 12 is for storing paint, and the paint stored in this paint tank 12 is supplied to the painting device 20 through the main line 11 and branch line 15. In addition, among the paint supplied to the main line 11 from the paint tank 12, the paint which did not flow to the branch line 15 is returned to the paint tank 12 again through the main line 11. In the present embodiment, the metallic paint containing metallic pigment such as aluminum flake is stored in the paint tank 12 as automotive top-coat paint.

The supply pump 13 is a driving means for pressure feeding the paint flowing in the main line 11, and is an electrical pump that pressure feeds paint by the driving of a motor. The pressure is applied to the paint flowing in the main line 11 by this supply pump 13 to send to the painting device 20 side through the branch line 15. The supply pump 13 of the present embodiment is arranged on a downstream side of the paint tank 12. In addition, the supply pump 13 is electrically connected to the control device 50 described later via an inverter 51, whereby the revolution speed of the motor is adjustable based on a signal from the control device 50. The control device 50 adjusts the flow pressure of paint flowing inside of the main line 11 by controlling the revolution speed via the inverter 51.

The main-line pressure sensor 14 is a measurement means for measuring the flow pressure of paint inside of the main line 11. The main-line pressure sensor 14 of the present embodiment is arranged on a downstream side of the supply pump 13. In addition, the main-line pressure sensor 14 is connected to be able to transmit measurement information by electrical signals to the control device 50.

The branch line 15 is plumbing that branches from the main line 11, and is connected to the painting device 20. The branch line 15 of the present embodiment branches between the main-line pressure sensor 14 of the main line 11 and the paint tank 12. In this way, the branch line 15 has an upstream-side end thereof connected to the main line 11, and a downstream-side end thereof connected to the painting device 20. It should be noted that although a plurality of the branch lines 15 branch from the main line 11 depending on the number of painting devices 20, and the painting devices 20 are connected to each of the branch lines 15, the drawing illustrates the painting device 20 as being one for simplification, and shows only a part of the branch lines 15.

The branch-line pressure sensor 16 is a measurement means for measuring the pressure inside of the branch line 15. The branch-line pressure sensor 16 of the present embodiment is arranged in the vicinity of a connecting portion of the branch line 15 with the main line 11. In addition, the branch-line pressure sensor 16 is connected to the control device 50 to be able to transmit measurement information by way of electrical signals.

Next, the painting device 20 will be explained. The painting device 20 is equipment for performing painting on a painting target such as the body of an automobile. The painting device 20 of the present embodiment includes a manifold 21, color-change valve 22, flushable gear pump 23 and paint gun 24.

The manifold 21 is configured to be able to connect to a plurality of color-change valves 22 to which the branch line 15 is connected. The manifold 21 is connected to the paint gun 24 via a flushable gear pump 23.

The color-change valve 22 is for performing the color changing of paints. A downstream-side end of the branch line 15 is connected to the color-change valve 22. A plurality of the color-change valves 22 is connected to the manifold 21, and is configured to be switchable according to the color change. In addition, the branch lines 15*a*, 15*b* of the paint circulation system differing for every color to be painted are each connected in the same way to the color-change valves 22, 22*a* and 22*b*, respectively. It should be noted that, in the drawings, illustration of the paint circulation system connected to the color-change valves 22*a*, 22*b* is omitted.

The flushable gear pump 23 is a supply pump that feeds to the paint gun 24 by applying pressure to the paint supplied to the painting device 20. The flushable gear pump 23 is connected to the manifold 21 along with being connected to the paint gun 24. The paint supplied from the branch line 15 is sent to the paint gun 24 by the flushable gear pump 23 through the color change valve 22 and manifold 21. It should be noted that the flushable gear pump 23 has a cleaning function for self-cleaning, and performs self-cleaning at an appropriate timing.

The paint gun 24 is a painting means for performing electrostatic painting of spraying paint onto the painting target. The paint supplied from the paint tank 12 to the painting device 20 through the main line 11 and branch line 15 is sprayed to the painting target by the spraying of this paint gun 24. In addition, the paint gun 24 is connected to enable transfer of operating information by way of electrical signals to the control device 50, whereby the control device 50 becomes able to detect whether or not the paint gun 24 is operating.

Figure 2:
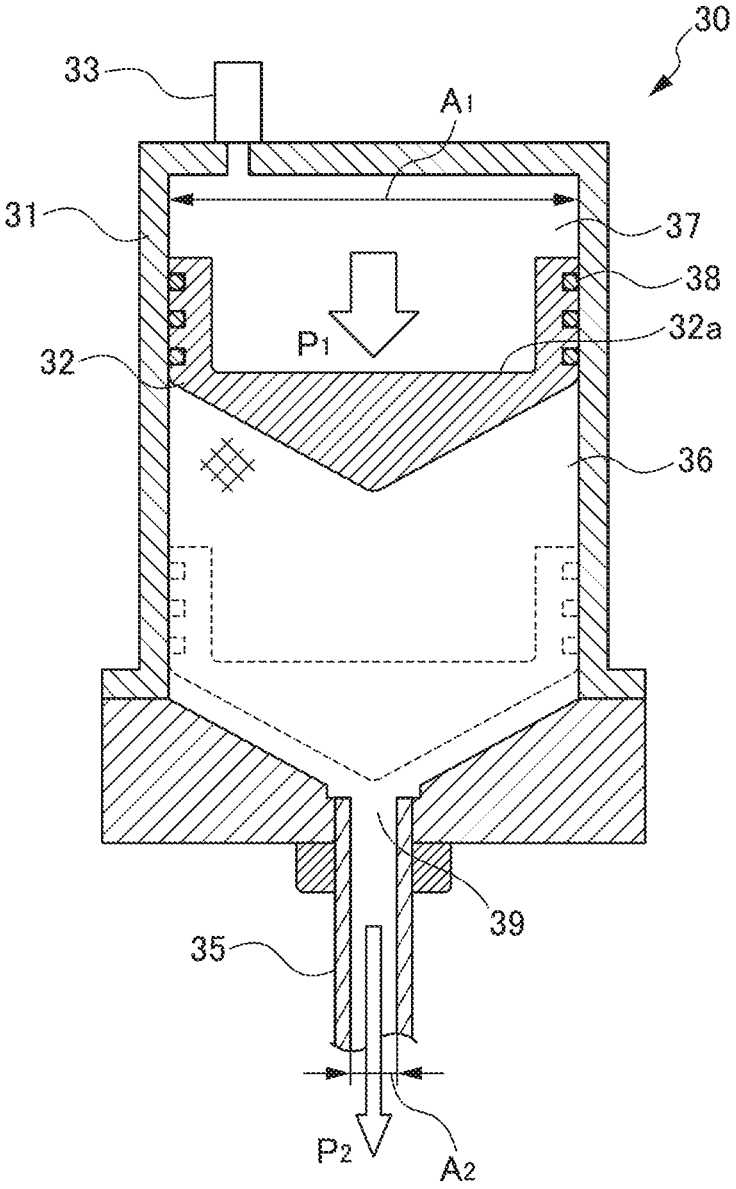
FIG. 2 is a view schematically showing an aspect of the inside of a pressurization device.
Figure 3:
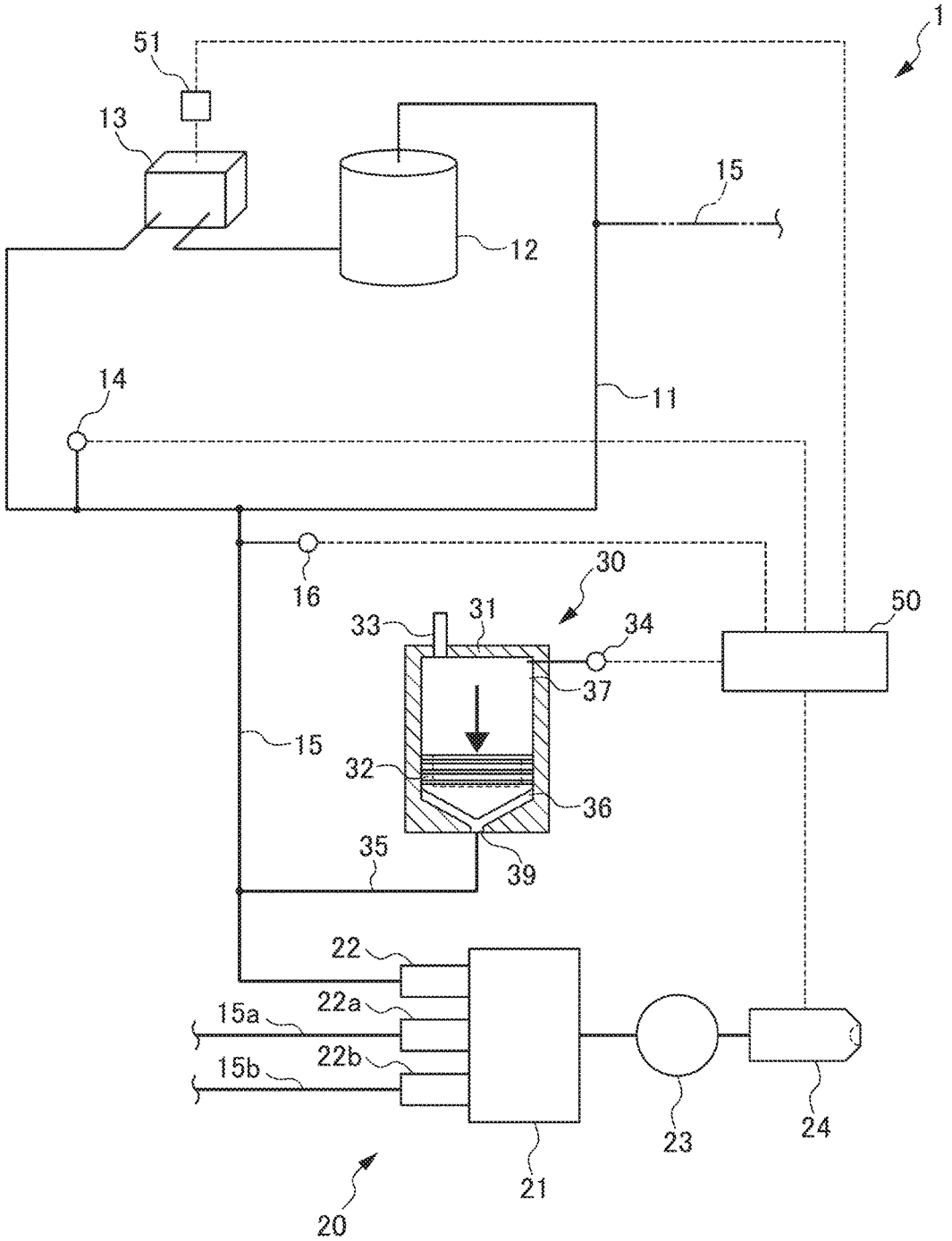
FIG. 3 is a view schematically showing a paint circulation system in a state in which a piston of the pressurization device is applying pressure.

Next, the pressurization device 30 will be explained. FIG. 2 is a view schematically showing an aspect of the inside of the pressurization device 30. FIG. 3 is a view schematically showing the paint circulation system 1 in a state in which the piston 32 of the pressurization device 30 is applying pressure. The pressurization device 30 prevents sedimentation of paint occurring inside of the main line 11 and branch line 15. According to this pressurization device 30 and the driving control of the supply pump 13 by the control device 50, it is possible to cause flow to occur in the opposite direction to the direction in which paint is supplied in the branch line 15. The details of the driving control of the supply pump 13 will be described later.

As shown in FIGS. 1 and 2, the pressurization device 30 of the present embodiment includes a main body 31, piston 32, pressure regulating valve 33, pressure sensor 34 and pressurized line 35.

The main body 31 is formed in a cylindrical shape having a hollow portion in the center. The piston 32 is supported inside of this main body 31. In addition, a storage chamber 36 and accumulator 37 sandwiching the piston 32 are formed inside of the main body 31. The storage chamber 36 is positioned on a lower side of the piston 32 (one side in the axial direction). An inlet port 39 to which the pressurized line 35 is connected is formed at a lower part of the storage chamber 36. The storage chamber 36 is connected in communication with the branch line 15 via the inlet port 39 and pressurized line 35, whereby the paint flowing in the branch line 15 becomes able to flow thereinto. On the other hand, the accumulator 37 is positioned at an upper side of the piston 32 (other side in axial direction), configured to be sealable, and air is filled to the inside thereof.

The piston 32 is supported to be slidable inside of the main body 31. In the piston 32 of the present embodiment, the storage chamber 36 side thereof (one side in axial direction) is formed in a cone shape, and a dished part 32*a* is formed in a face on the accumulator 37 side thereof (other side in axial direction). By the dished part 32*a* being formed in the face on the accumulator 37 side of the piston 32, it becomes possible to enlarge the internal volume of the accumulator 37. The pressurization device 30 maintaining the volume for performing sufficient pressure storage while establishing the device configuration as compact is thereby realized.

In addition, in the piston 32 of the present embodiment, a plurality of grooves for installing sealing rings 38 of ring shape is formed in the cylinder face thereof, and the sealing rings 38 are installed in these grooves, respectively. The portion at which the inside wall of the main body 31 and the piston 32 contact becomes a liquid-tight structure by the sealing rings 38 arranged in the cylinder surface of the piston 32, whereby the paint having flowed into the storage chamber 36 will not pour into the accumulator 37 side.

The pressure regulating valve 33 serving as a pressure regulator is a regulator that keeps the pressure inside of the accumulator 37 at a fixed predetermined pressure. The pressure inside of the accumulator 37 is kept constant by this pressure regulating valve 33. The pressure regulating valve 33 of the present embodiment functions as a relief valve that will exhaust the air inside of the accumulator 37 to outside when exceeding a predetermined pressure.

The pressurization sensor 34 is a measuring means for measuring the pressure inside of the accumulator. The pressurization sensor 34 is connected to be able to send measurement information by way of electrical signals to the control device 50.

The pressurized line 35 connects the inlet port 39 of the pressurization device 30 and the branch line 15. The storage chamber 36 of the main body 31 and the branch line 15 are connected to be in communication by this pressurized line 35. The branch line 15 and storage chamber 36 are in communication via the pressurized line 35, whereby paint of the branch line 15 can be introduced into the storage chamber 36. A predetermined pressure is continuously applied to the branch line 15 via this pressurized line 35.

Next, the pressure storage and pressurization by the pressurization device 30 will be explained while showing the relationship between the movement of the piston 32 and pressure. As shown in FIG. 2, the pressure inside of the accumulator 37 is defined as $P_1$, the cross-sectional area of the piston 32 is defined as $A_1$, the port pressure of the inlet port 39 is defined as $P_2$, and the cross-sectional area of the inlet port 39 is defined as $A_2$. It is thereby possible to express a state in which the piston 32 is static at the inside of the main body 31 by way of the following numeric expression 1.

$$P_1 \times A_1 = P_2 \times A_2 \quad \text{(Eq. 1)}$$

First, pressure storage will be explained. The pressurization device 30 enters a pressure storage state by the port pressure $P_2$, which is the pressure of paint in the pressurized line 35, becoming higher than the pressure $P_1$ inside of the accumulator 37. By the piston 32 being pushed up to the accumulator 37 side by the port pressure $P_2$, the air inside of the accumulator 37 is compressed, whereby the pressure of filled air rises. The paint of the compressed volume flows into the storage chamber 36, thereby entering a state in which paint is stored in the storage chamber 36, and energy is reserved in the pressurization device 30 (refer to FIG. 1).

In a pressure storing state, the pressure $P_1$ inside of the accumulator 37 gradually rises, and soon reaches a predetermined pressure. In the present embodiment, the pressure inside of the accumulator 37 is maintained at the predetermined pressure by the pressure regulating valve 33 functioning as a relief valve. In other words, even if the piston 32 rises in a state having reached the predetermined pressure, it is configured so that the air will be discharged to outside of the accumulator 37 by the pressure regulating valve 33, and the pressure inside of the accumulator 37 will not rise higher than this. In a state where this pressure storage has completed, $P_1$ that is the pressure inside of the accumulator 37 can be obtained based on the port pressure $P_2$, which is the pressure of the paint.

Next, pressurization will be explained. The pressurization device 30 enters a pressurized state by the port pressure $P_2$ that is the pressure of the paint in the pressurized line 35 becoming lower than the pressure $P_1$ inside of the accumulator 37. The air compressed expands by the lowering of the port pressure $P_2$, and the piston 32 moves to the storage chamber side. A state is thereby entered in which the paint having flowed to inside of the storage chamber 36 is pressed out from the inlet port 39 to the pressurized line 35, and the energy stored from the pressurization device 30 is released (refer to FIG. 3).

In the pressurized state, the pressure inside of the accumulator 37 becomes gradually lower accompanying the movement of the piston 32. As mentioned above, since the pressurized line 35 is connected to the branch line 15, paint pressed out to the pressurized line 35 flows to the branch line 15, whereby reverse flow of paint occurs. In an equilibrium state in which the movement of the piston 32 stops, the pressure $P_2$ received by the paint inside of the pressurized line 35 from the pressurization device 30 can be obtained based on the pressure $P_1$ inside of the accumulator 37 according to equation 1.

Next, the control device 50 will be explained. The control device 50 performs drive control of the supply pump 13, and along with performing supply control to supply paint to the painting device 20 in the operating state of spraying paint from the paint gun 24, performs sedimentation prevention control to prevent the sedimentation of paint such as when not spraying paint from the paint gun 24. It should be noted that the details of supply control and sedimentation prevention control by the control device 50 will be described later.

In the above configuration, the paint circulation system 1 of the first embodiment performs the supply of paint to the painting device 20 via the main line 11 and branch line 15 from the paint tank 12. The paint supplied to the painting device 20 is sent to the paint gun 24 in a state applied pressure by the flushable gear pump 23 through the color-change valve 22 and manifold 21. The paint is sprayed to the painting target by the paint gun 24, and the painting operation is performed. In the present embodiment, the paint gun 24 is held by a painting robot (omitted from illustrations) including an arm, etc., and the painting operation is performed automatically by this painting robot.

Figure 4:
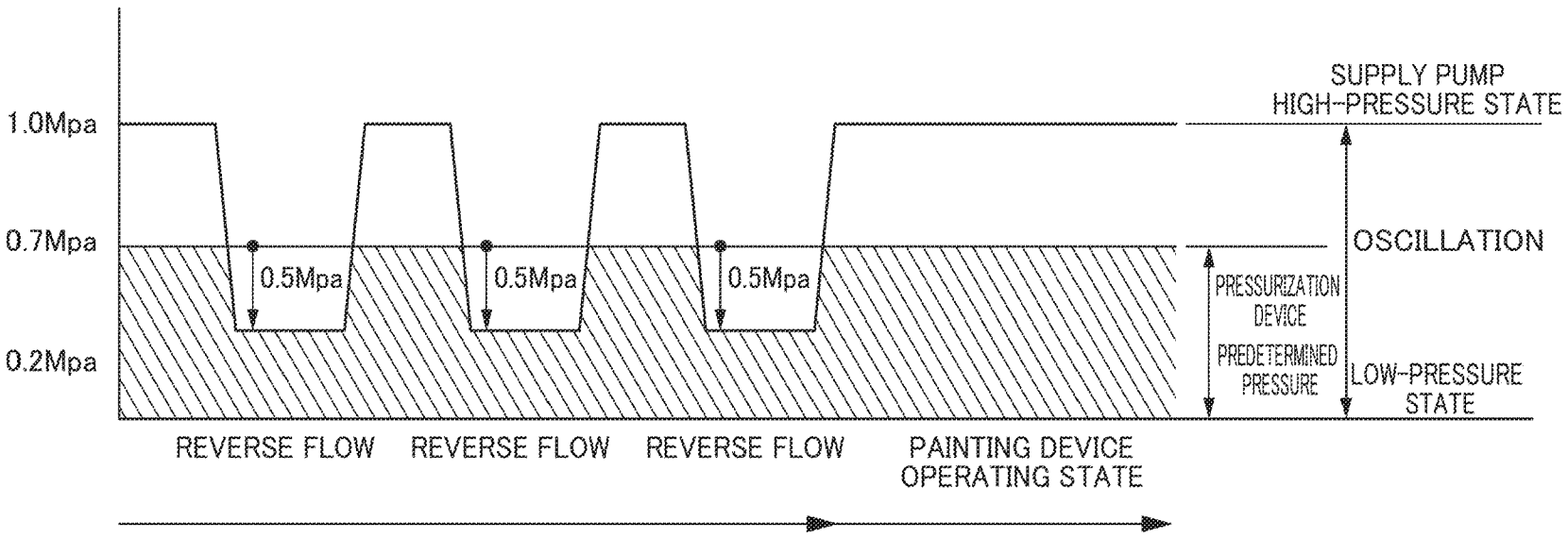
FIG. 4 is a graph showing the relationship between the pressure of a supply pump and the flow state of paint.

Next, the details of supply control and sedimentation prevention control by the control device 50 will be explained. FIG. 4 is a graph showing the relationship between the pressure of the supply pump 13 and the flow state of paint. First, supply control will be explained. The control device 50 of the present embodiment performs supply control in a state of the paint gun 24 operating, which is a state where the paint stored in the paint tank 12 that is illustrated as one circuit of color-change valves 22, **22*a*, 22*b* is being selected as the paint for performing painting. For example, the control device 50 detects the operation of the painting device 20 (paint gun 24) based on an operation signal inputted from the paint gun 24, and continues supply control in the case of the paint being used (painting device operating state in FIG. 4**).

In supply control, the driving of the supply pump 13 is controlled by the control device 50 so that the pressure inside of the main line 11 reaches the supply pressure set in advance. The supply pressure is the pressure that enables appropriate supply of the paint to the painting device 20, and is set so as to be higher pressure than the predetermined pressure of the accumulator 37, which is adjusted by the pressure regulating valve 33. For example, as shown in FIG. 4, in the case of the predetermined pressure of the accumulator 37 being set to 0.7 MPa, the supply pressure is set to 1.0 MPa. The paint is supplied to the painting device 20 by the supply pump 13 being driven so as to be higher pressure than the pressure applied to the branch line 15 by the pressurization device 30. As described above, the measurement signals of each sensor such as the main-line pressure sensor 14, branch-line pressure sensor 16 and pressurization sensor 34 are inputted to the control device 50. The control device 50 controls the driving of the supply pump 13 so as to become the supply pressure based on these measurement signals. By the supply pump 13 being subjected to supply control by the control device 50, the paint inside of the main line 11 is sent to the downstream side, and sent to the painting device 20 by branching at the branch line 15 to the painting device 20 side. By the control device 50 driving the supply pump 13 at the supply pressure, it is possible to continuously cause forward flow in which the paint flows to the painting device 20 side.

In addition, in supply control, pressure higher than the predetermined pressure of the accumulator 37 is applied to the branch line 15 via the main line 11. By the pressure inside of the main line 11 becoming higher than the predetermined pressure inside of the accumulator 37 by way of the supply pump 13, the piston 32 moves to a storage position on the upper side (accumulator 37 side). The paint streams into the storage chamber 36 through the inlet port 39 from the branch line 15 side via the pressurized line 35 accompanying this movement of the piston 32, thereby entering a state in which paint is stored in this storage chamber 36 (refer to FIG. 1). The paint flows into the storage chamber 36 connected in communication with the branch line 15, and the piston 32 moves upwards. In other words, in supply control, a state is entered in which paint is stored in the storage chamber 36 of the pressurization device 30.

Sedimentation prevention control will be explained. In sedimentation prevention control, control to establish the pressure of paint inside of the main line 11 in a high-pressure state higher than the predetermined pressure of the pressurization device 30, and control to establish the pressure of paint inside of the main line 11 in a low-pressure state lower than the predetermined pressure of the pressurization device 30 are alternately performed by the drive control of the supply pump 13.

First, control to establish the pressure of paint inside of the main line 11 in a high-pressure state higher than the predetermined pressure of the pressurization device 30 will be explained. The control device 50 drive controls the supply pump 13 so that the pressure of paint inside of the main line 11 becomes higher pressure than the predetermined pressure of the accumulator 37, and causes the forward flow to occur in which the paint inside of the branch line 15 flows to the painting device 20 side. By the pressure inside of the main line 11 becoming higher than the predetermined pressure inside of the accumulator 37 by way of the supply pump 13, the piston 32 moves to the storage position on the upper side (accumulator 37 side) similarly to supply control. The paint streams into the storage chamber 36 from the branch line 15 side via the pressurized line 35 accompanying this movement of the piston 32, thereby entering a state in which paint is stored in the storage chamber 36 (refer to FIG. 1).

Next, the control to establish the pressure of paint inside of the main line 11 in a low-pressure state lower than the predetermined pressure of the pressurization device 30 will be explained. The control device 50 causes flow to occur in which paint backflows to the upstream side inside of the branch line 15, by drive controlling the supply pump 13 so that the pressure inside of the main line 11 reaches a target pressure that is lower pressure than the predetermined pressure of the accumulator 37. The control device 50 controls driving of the supply pump 13 so as to reach the target pressure based on the measurement signals of each sensor such as the main-line pressure sensor 14, branch-line pressure sensor 16 and pressurization sensor 34. It should be noted that the target pressure is a pressure at which reverse flow of paint from the branch line 15 to the main line 11 occurs, and is set according to the predetermined pressure. For example, as shown in FIG. 4, in the case of the predetermined pressure of the accumulator 37 being set to 0.7 MPa, the target pressure is set to 0.2 MPa.

The flow of paint during reverse flow will be explained. As shown in FIG. 4, during reverse flow, the supply pump 13 is drive controlled so that the flow pressure of paint inside of the main line 11 becomes lower than the predetermined pressure inside of the accumulator 37. The piston 32 thereby moves to a pressurization position on a lower side (storage chamber 36 side), as shown in FIG. 3. The paint stored inside of the storage chamber 36 is pressurized at the piston 32 and moves to the branch line 15 side through the pressurized line 35, accompanying the movement of the piston 32. It should be noted that the paint stored in the storage chamber 36 is paint that was introduced to the storage chamber 36 during the forward flow for supply control or sedimentation prevention control. In sedimentation prevention control, since the paint is not being supplied to the paint gun 24, the paint moves without being consumed on the painting device 20 side to the main line 11 side, which is in a state of the pressure being low inside of the branch line 15. By the paint moving to the main line 11 side, reverse flow in the opposite direction to the flow when paint is supplied occurs, whereby sedimentation of paint occurring due to paint stagnation is prevented. Since the pressurized line 35 is connected in the vicinity of the color-change valve 22, most of the paint inside of the branch line 15 moves to the main line 11 side. In this way, the paint circulation system of the present embodiment is able to cause reverse flow in which the paint from the painting device 20 side returns to the main line 11 side to occur by simply performing drive control of the supply pump 13, which is arranged in the main line 11.

In sedimentation prevention control, the supply pressure of the supply pump 13 is drive controlled by the control device 50 so that the aforementioned forward flow in which paint flows from the main line 11 side to the painting device 20 side similarly the supply control, and the aforementioned reverse flow in which paint flows from the painting device 20 side to the main line 11 side are alternately repeated. It should be noted that the timing at which switching between forward flow and reverse flow can be decided by referencing the measurement signals of each sensor such as the main-line pressure sensor 14, branch-line pressure sensor 16 and pressurized line 34.

In the present embodiment, the control device 50 drive controls the supply pump 30 so as to cause reverse flow to occur after driving the supply pump 13 for a predetermined time so as to cause forward flow to occur at a standby time or stop time. In addition, the control device 50 drive controls the supply pimp 13 so as to cause forward flow to occur after having driven the supply pump 13 for a predetermined time so as to cause reverse flow to occur. In this way, the control device 50 repeats drive control to cause forward flow to occur and drive control to cause reverse flow to occur at predetermined time intervals. Sedimentation of paint occurring due to stagnation inside of the main line 11 and branch line 15 is thereby effectively prevented. In this way, the control device 50 performs sedimentation prevention control when supply control is not being performed. When supply control is not being performed indicates when spraying of the paint gun 24 with the paint supplied from the aforementioned paint tank 12 is not being performed. Therefore, sedimentation prevention control is performed in a state in which the paint stored in the aforementioned paint tank 12 is not being supplied to the paint gun 24 such as during standby or during stop when different types of paints are being supplied to the paint gun 24 during operation from the paint circulation system of a different circuit than the circuit when connected to the color-change valve 22. More specifically, it is a time such as when the color-change valve 22 to which the aforementioned branch line 15 is connected enters a closed state, and a different color paint is supplied to the painting device 20 from the branch line 15 connected to other color-change valves 22*a*, 22*b*.

It should be noted that, in the present embodiment, the control device 50 drive controls the supply pump 13 so as to cause forward flow to occur, after having driven the supply pump 13 for a predetermined time to cause reverse flow to occur, when transitioning from supply control to sedimentation prevention control. It is thereby possible to cause one time of reverse flow to occur in sedimentation prevention control using the energy stored in supply control, and possible to smoothly perform transition from supply control to sedimentation prevention control, together with the efficient application of the paint circulation system 1 being able to be realized.

Next, transition from sedimentation prevention control to supply control will be explained. The control device 50 stops sedimentation prevention control prior to a predetermined time of starting supply control, when transitioning from sedimentation prevention control to supply control. By stopping sedimentation prevention control before a predetermined time at which supply control is started, it is possible to smoothly perform the supply of paint when starting supply control, without being subjected to the influences of sedimentation prevention control such as pulsations. It should be noted that the timing at which stopping sedimentation prevention control prior to the start of supply control can be set by an appropriate method. For example, the timing at which to stop sedimentation prevention control may be determined based on a schedule, timer, etc. set in advance. In addition, it may be configured so that the control device 50 starts supply control after stopping sedimentation prevention control based on an operating signal of the paint gun 24 (painting device 20), and a predetermined time elapsing. In this way, the flow caused by sedimentation prevention control can be effectively prevented from influencing supply control by starting supply control at an interval after sedimentation prevention control finishes.

The following such effects are exerted according to the paint circulation system 1 of the first embodiment explained above.

The paint circulation system 1 of the first embodiment includes: the loop-shaped main line 11 to which paint is supplied from the paint tank 12, the branch line 15 that branches from the main line 11 and is connected to the painting device 20, the supply pump 13 that pressure-feeds paint supplied to the main line 11 to the painting device 20 side, and the pressurization device 30 that stores pressure of the paint in a high-pressure state in which the pressure of the paint pressure fed by the supply pump 13 is higher than a predetermined pressure, and applies pressure to the paint inside of the branch line 15 in a low-pressure state in which the pressure of the paint becomes lower than the predetermined pressure, where the system performs sedimentation prevention control to prevent sedimentation of the paint by drive controlling the supply pump 13 so that the high-pressure state and low-pressure state occur, thereby causing flow sending the paint inside of the branch line 15 from the painting device 20 side to the main line 11 using a pressure difference between the predetermined pressure in the low-pressure state and the pressure of the paint.

Since it is thereby possible to cause the paint in the branch line 15 to reverse flow to the main line 11 side using the pressure difference between the inside of the main line 11 and the inside of the branch line 15, sedimentation of paint occurring due to stagnation can be effectively prevented. In addition, since sedimentation of paint is prevented according to drive control of the supply pump 13 feeding the paint in the paint tank 12 to the painting device 20 side, it is unnecessary to separately provide large-scale plumbing such as that connecting the paint tank 12 from the painting device 20 in order to return paint to the paint tank 12, a configuration to control the driving means for causing paint to circulate at the painting device 20 side or the like, and thus it is possible to realize a cost reduction and space savings in the paint circulation system 1 that can prevent the sedimentation of paint. For metallic paint like that used in the present embodiment or pearl paint, the sedimentation of paint occurs relatively easily when supply control of paint is not being performed. Since flow in the opposite direction from during supply control occurs within the plumbing according to the paint circulation system 1 of the present embodiment, it can effectively prevent the sedimentation of paint even in the case of using such paints.

The pressurization device 30 includes the main body 31 having a hollow portion at the inside, the piston 32 that slides inside of the main body 31, the storage chamber 36 that is arranged at one side in the axial direction of the piston 32 inside of the main body 31 and is in communication with the branch line 15, the accumulator 37 that is arranged at the other side in the axial direction of the piston 32 inside of the main body 31 and into which a gas is filled, and the pressure regulating valve 33 that regulates the pressure of the accumulator 37 to a predetermined pressure.

Since the inside of the accumulator 37 is thereby maintained at a predetermined pressure by the pressure regulating valve 33, it is possible to continuously apply the predetermined pressure to the paint flowing through the branch line 15 via the piston 32, and simply configure the device configuration preventing the sedimentation of paint. In addition, since the required volume of the main body 31 can be appropriately and simply set according to the length of the branch line 15, etc. due to being configured in piston type, it is possible to easily apply the appropriate configuration for preventing the sedimentation of paint in various paint circulation systems.

In the sedimentation prevention control, the control device 50 drive controls the supply pump 13 so that the pressure inside of the main line 11 changes at predetermined time intervals between a high-pressure state higher than a predetermined pressure and a low-pressure state lower than the predetermined pressure.

It is thereby possible to more effectively prevent sedimentation of paint occurring due to stagnation, since the movement of paint flowing to the painting device 20 side and movement of reverse flowing to this flow are repeated in sedimentation prevention control. In addition, compared to a configuration in which the supply pump 13 is continually driven at high pressure even in a state of the painting device 20 not operating, since the time of driving the supply pump 13 at low pressure lengthens, it is possible to suppress the energy consumption for driving the supply pump 13 overall.

The pressurization device 30 is connected to be in communication with the branch line 15 in the vicinity of the painting device 20.

Compared to a configuration in which the pressurization device 30 is connected to the main line 11 side of the branch line 15, it is thereby possible to lengthen the portion in which paint reverse flows in the branch line 15, and thus more effectively prevent the sedimentation of paint.

Figure 5:
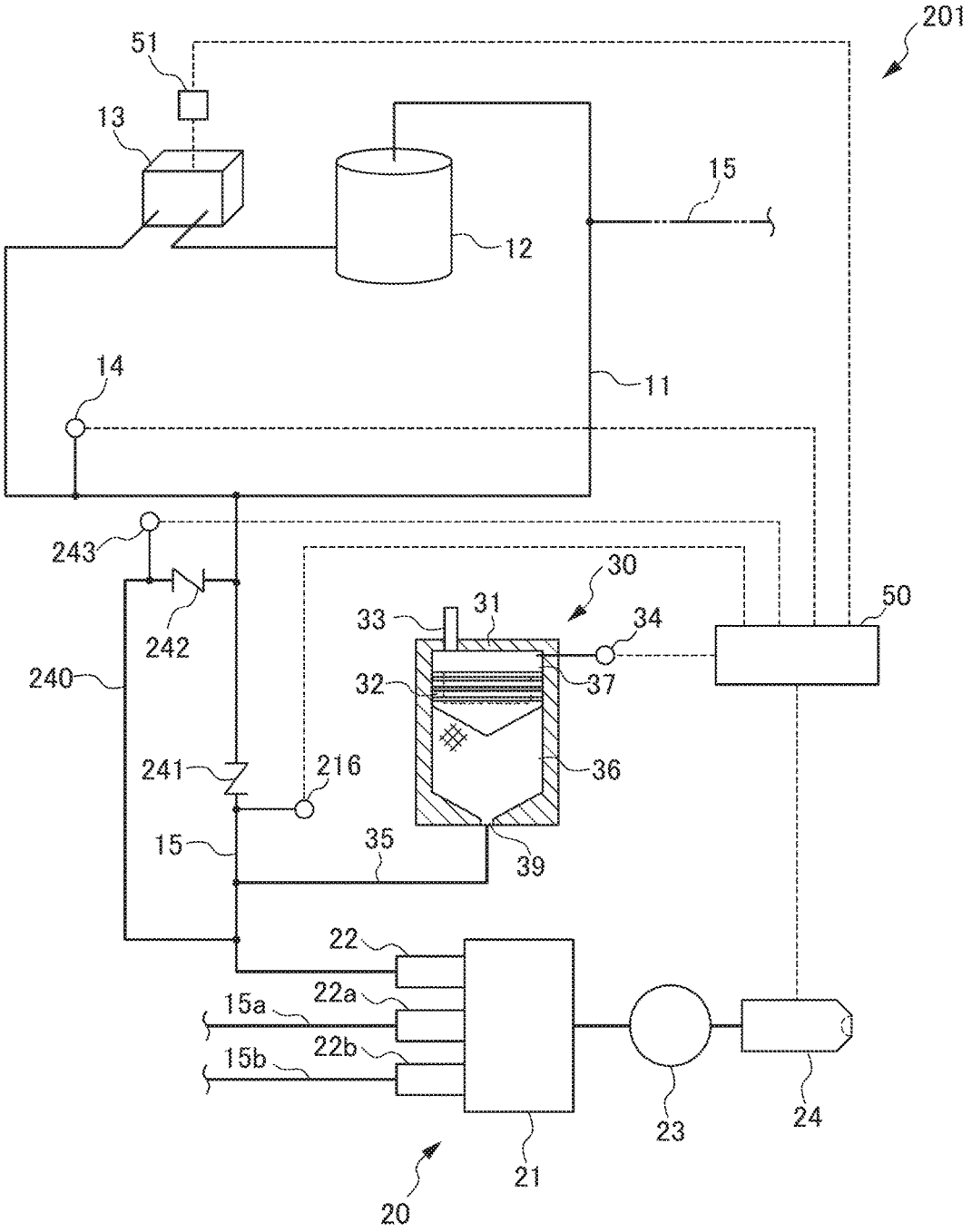
FIG. 5 is a view schematically showing a paint circulation system of a second embodiment.

Next, a paint circulation system 201 of the second embodiment will be explained. FIG. 5 is a view schematically showing the paint circulation device 201 of the second embodiment. The paint circulation system 201 of the second embodiment is configured so as to provide a bypass line 240 to the branch line 15 to return paint inside of the branch line 15 via this bypass line 240 to the main line 11 side. It should be noted that, in the following explanation, explanations for similar configurations to the configurations of the paint circulation system 1 of the first embodiment may be omitted.

As shown in FIG. 5, the paint circulation system 201 of the second embodiment differs from the configuration of the paint circulation system 1 of the first embodiment in the point of including the bypass line 240, unidirectional valving means consisting of the branch-line check valve 241 serving as a first check valve and a bypass-line check valve 242 serving as a second check valve, and a bypass-line pressure sensor 243. These configurations will be explained below.

The bypass line 240 is plumbing that sends the paint inside of the branch line 15 to the main line 11 side in sedimentation prevention control. In the bypass line 240 of the present embodiment, an end on one side thereof is connected in the vicinity of a downstream end of the branch line 15 (end on color change valve 22 side), and an end on the other side thereof is connected in the vicinity of the upstream-side end of the branch line 15 (end on main line 11 side).

The branch-line check valve 241 is arranged in the branch line 15, and prevents the flow of paint from the painting device 20 side to the main line 11 side. The branch line check valve 241 of the present embodiment is arranged more to the side of the main line 11 than a portion of the branch line 15 to which the pressurized line 35 is connected. In addition, the branch-line check valve 241 of the present embodiment is positioned in the branch line 15 more to the painting device 20 side than a portion at which the end of the other side of the bypass line 240 is connected.

The bypass-line check valve 242 is arranged in the bypass line 240, and prevents the flow of paint from the main line 11 side to the painting device 20 side. The bypass-line check valve 242 of the present embodiment is arranged in the vicinity of an end on the main line 11 side.

The bypass-line pressure sensor 243 is a measuring means for measuring the pressure inside the bypass line 240, and is arranged in the vicinity of an end on the main line 11 side. The bypass-line pressure sensor 243 is electrically connected to the control device 50. Pressure anomalies arising in the bypass line 240 become detectable by this bypass-line pressure sensor 243.

In addition, in the second embodiment, the branch-line pressure sensor 216 of the paint circulation system 201 is arranged between the portion of the branch line 15 at which the pressurized line 35 is connected, and the branch-line check valve 241.

In the above configuration, drive control of the supply pump 13 is performed by the control device 50. In the paint circulation system 201 of the second embodiment, supply control and sedimentation prevention control are performed similarly to the first embodiment.

The flow of paint in supply control of the second embodiment will be explained. In supply control, paint is fed from the main line 11 through the branch line 15 to the painting device 20 side, as described above. At this time, the flow to the bypass line 240 branching at the main line 11 side from the branch line 15 is obstructed by the bypass-line check valve 242. In other words, the paint from the end on the main line 11 side is fed to the painting device 20 side through the branch line 15 without flowing into bypass line 240.

Next, sedimentation prevention control of the second embodiment will be explained. The control device 50 of the second embodiment controls the supply pump 13 so as to repeat forward flow in which paint flows in the same direction as supply control, and reverse flow in which paint returns to the main line 11 side through the bypass line 240, similarly to the first embodiment. The measurement signals of each sensor such as the main-line pressure sensor 14, branch-line pressure sensor 16, pressurization sensor 34 and bypass-line pressure sensor 243 are inputted to the control device 50, which controls driving of the supply pump 13 based on these measurement signals. It should be noted that the driving control of the supply pump 13 in sedimentation prevention control is similar to the first embodiment, and thus detailed explanations thereof will be omitted.

In sedimentation prevention control, since movement to the main line 11 side is obstructed by the branch-line check valve 241, the paint returned from the pressurized line 35 to the branch line 15 is fed to the main line 11 side of the branch line 15 through the bypass line 240. Flow thereby generates inside of the branch line 15 and main line 11, whereby the sedimentation of paint is prevented. In addition, as mentioned above, since control to repeat forward flow and reverse flow at predetermined intervals is performed also in the second embodiment, the sedimentation of paint is effectively prevented.

The following such effects are exerted according to the paint circulation system 201 of the second embodiment explained above.

The paint circulation system 201 of the second embodiment includes the bypass line 240 in which the end on one side is connected more to the painting device 20 side in the branch line 15 than a portion at which the pressurization device 30 is connected, and the end on the other side is connected more to the main line 11 side in the branch line 15 than a portion at which the pressurization device 30 is connected, whereby sedimentation prevention control causes flow to occur that feeds paint from the painting device 20 side to the main line 11 side through the bypass line 240.

Since it is thereby possible to cause flow to occur in which the paint flows through the bypass line 240 to the main line 11 side, the position at which the pressurization device 30 is connected in communication to the branch line 15 can be established freely, and thus the degree of freedom in device configuration can be improved. In addition, by connecting the end on one side of the bypass line 240 at the vicinity of the painting device 20, it is possible to lengthen the portion in which paint flows in the branch line 15 during reverse flow generation by the pressurization device 30, and thus the sedimentation of paint can be prevented more effectively.

In addition, the paint circulation system 201 of the second embodiment further includes a unidirectional valving means consisting of: the branch-line check valve 241 that is arranged in the branch line 15 more to the main line 11 side than a portion at which the pressurization device 30 is connected, and more to the painting device 20 side than a portion at which an end on the other side of the bypass line 240 is connected, and inhibits flow of the paint from the painting device 20 side to the main line 11 side; and the bypass-line check valve 242 that is arranged in the bypass line 240 and inhibits flow to an end on one side from the end on the other side. Then, only flow of paint is permitted in one direction flowing to the painting device 20 side through a portion at which the pressurization device 30 is connected in the branch line 15, and only flow of paint is permitted in one direction flowing to the main line 11 side through the bypass line 240, by the unidirectional valving means consisting of the branch-line check valve 241 and bypass-line check valve 242.

In the supply control supplying paint to the painting device 20, it is thereby possible to prevent the influx of paint to the bypass line 240 by way of the bypass-line check valve 242. In addition, in the sedimentation prevention control, since it is possible to prevent flow trying to reverse flow through the branch line 15 without passing the bypass line 240 by way of the branch-line check valve 241, it is possible to reliably return paint to the main line 11 side through the bypass line 240.

Figure 6:
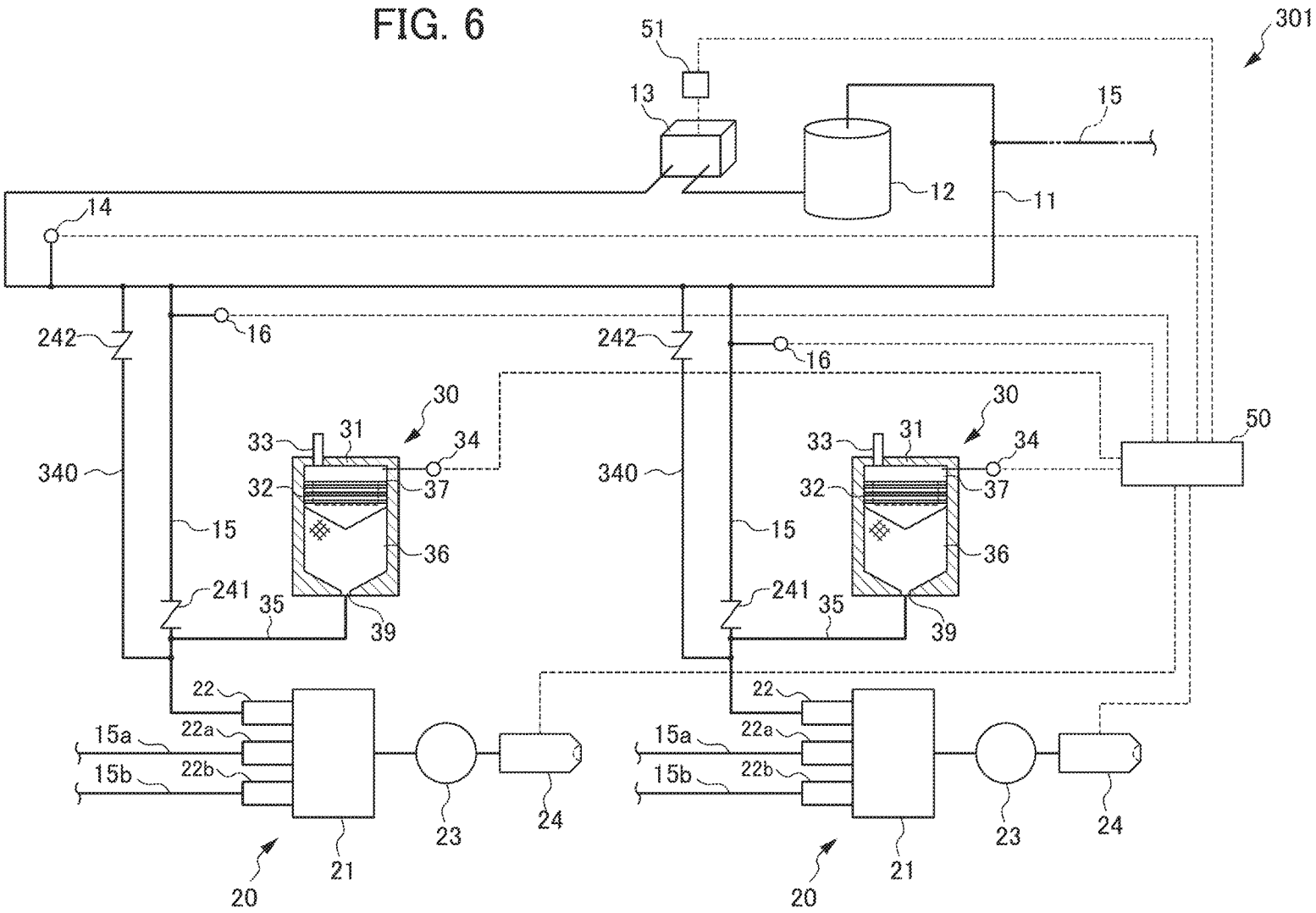
FIG. 6 is a view schematically showing a paint circulation system of a third embodiment.

Next, a paint circulation system 301 of a third embodiment will be explained. FIG. 6 is a view schematically showing the paint circulation system 301 of the third embodiment. As shown in FIG. 6, the paint circulation system 301 includes the main line 11, paint tank 12, supply pump 13, main-line pressure sensor 14, a plurality of painting devices 20, the pressurization device 30 corresponding to the plurality of devices, the branch line 15 and the bypass line 340. It should be noted that, in the present embodiment, although a plurality of the branch lines 15 branch from the main line 11 depending on the number of painting devices 20, and the painting devices 20 are connected to the respective branch lines 15, for simplification, two of the painting devices 20 are illustrated in the drawings, and the branch lines 15 are only partially illustrated.

The paint circulation system 301 of the third embodiment differs from the paint circulation system 201 of the second embodiment in the configuration of the bypass line 340. It should be noted that the supply control, sedimentation prevention control and flow of paint in the third embodiment are similar to the first embodiment and second embodiment; therefore, detailed explanations thereof will be omitted.

In addition, in the third embodiment, the bypass line 340 has an end on one side thereof that is connected in the vicinity of the color change valve 22 in the branch line 15, and an end on the other side that is connected to the main line 11. Therefore, in sedimentation prevention control, flow whereby the paint of the branch line 15 returns directly from the bypass line 340 to the main line 11 will occur. In this way, in the sedimentation prevention control of the paint circulation system 301 of the third embodiment, it is possible to cause different flow from the flow of paint in supply control to occur, whereby the sedimentation of paint can be effectively prevented.

Although each preferred embodiment of the paint circulation system of the present invention is explained above, the present invention is not to be limited to the aforementioned embodiments, and modifications thereto are possible as appropriate.

In the above-mentioned embodiments, although the control device 50 is a configuration that starts sedimentation prevention control when supply control is not being performed, the timing at which starting sedimentation prevention control can be changed as appropriate. For example, it may be configured so that the control device 50 performs sedimentation prevention control when supply control is not being performed and when satisfying predetermined conditions. It is also possible to set schedule information as the predetermined conditions. More specifically, it is possible to establish a configuration that starts sedimentation prevention control at the moment at which the event of painting not being performed for a predetermined time by the painting device 20 using the paint stored in the paint tank 12 reached a time period set in advance, according to a production schedule or the like. In addition, it may be made a configuration that starts sedimentation prevention control based on a closed condition of the color change valve 22, such as starting sedimentation prevention control in the case of the color change valve 22 to which the branch line 15 is connected being closed when the supply control is not being performed. In addition, it is possible to include the operating status of the paint gun 24 in the aforementioned predetermined conditions. Furthermore, it is possible establish a configuration including a timer in which the supply pump 13 is operation controlled so as to prevent sedimentation of paint at predetermined times. By using a timer in this way, the driving control can be made simple, and thus the control device 50 can be simplified. The condition for the control device 50 to start sedimentation prevention control can be set as appropriate based on various signals, information, etc. in this way.

Although the above-mentioned embodiments are configurations in which the pressure regulating valve 33 operates in either the case of supply control and sedimentation prevention control, it may configured so that the control device electronically controls the ON/OFF of the pressure regulating valve 33, or configured so that the pressure regulating valve 33 only operates during sedimentation prevention control.

In the above-mentioned embodiments, although the control device 50 is a configuration that performs supply control and sedimentation prevention control based on the measurement signals of various sensors (main-line pressure sensor 14, branch-line pressure sensor 16, pressurization sensor 34, bypass-line pressure sensor 243, etc.), this configuration can be modified as appropriate. For example, the bypass-line pressure sensor 243 can be omitted from the configuration of the second embodiment. In addition, further to the configurations of the above-mentioned embodiments, it may be made a configuration that detects anomalies in the paint circulation system based on the measurement signals of each of the aforementioned sensors. So long as being a configuration in which the control device 50 drives the supply pump 13 in this way so that the pressure inside the main line 11 becomes a pressure lower than a predetermined pressure set in the pressurization device 30 and can prevent the sedimentation of paint, it is possible to modify the configuration thereof as appropriate.

Although the above-mentioned embodiments are configurations in which the supply pressure and target pressure are set in advance, it can be made a configuration in which the control device 50 sets the supply pressure or target pressure based on the measurement signals of each sensor.

EXPLANATION OF REFERENCE NUMERALS

1 paint circulation system
11 main line
12 paint tank
13 supply pump
15 branch line
20 painting device (painting means)
30 pressurization device (pressurization means)
31 main body
32 piston
33 pressure regulating valve (pressure regulating unit)
36 storage chamber
37 accumulator
50 control device
201 paint circulation system
240 bypass line
241 branch-line check valve (unidirectional valving means)
242 bypass-line check valve (unidirectional valving means)
301 paint circulation system
340 bypass line

The invention claimed is:

1. A paint circulation system for supplying paint from a paint tank to a painting device, comprising:

a loop-like main line in which the paint is supplied from the paint tank;

a branch line that branches from the main line, and is connected to the painting device;

a supply pump that pressure-feeds the paint supplied to the main line toward the painting device;

a pressurization device for storing pressure of the paint in a high-pressure state in which the pressure of the paint pressure-fed by the supply pump is higher than a predetermined pressure, and for applying pressure to the paint inside of the branch line in a low-pressure state in which the pressure of the paint is lower than the predetermined pressure;

a bypass line having an end on one side connected to the branch line at a first position nearer the painting device than a position at which the pressurization device is connected to the branch line, and having an end on another side that is connected to the branch line at a second position nearer the main line than the position at which the pressurization device is connected to the branch line; and a unidirectional check valve that permits flow in one direction in the branch line toward the painting device, and permits flow in one direction in the bypass line from the second position toward the first position, wherein sedimentation of the paint is prevented by driving the supply pump so that the high-pressure state and the low-pressure state occur, to cause backflow returning of the paint inside of the branch line from a side of the painting device to a side of the main line using a pressure difference between the paint inside of the main line and the paint inside of the branch line in the low-pressure state, and wherein flow sending the paint from the first position to the second position through the bypass line is produced in the low-pressure state.

2. The paint circulation system according to claim 1, wherein the pressurization device includes:

a main body having a hollow portion inside thereof;

a piston that slides inside of the main body;

a storage chamber that is disposed at one side in an axial direction of the piston inside of the main body, and is in communication with the branch line;

an accumulator that is disposed at another side in the axial direction of the piston inside of the main body, and in which gas is filled; and a pressure regulating unit that regulates pressure of the accumulator to the predetermined pressure.

3. The paint circulation system according to claim 1, wherein the supply pump is driven so that the pressure inside of the main line varies at a predetermined time interval between the high-pressure state higher than the predetermined pressure and the low-pressure state lower than the predetermined pressure.

4. The paint circulation system according to claim 1, wherein the pressurization device is connected in communication with the branch line at a position adjacent to the painting device, rather than the main line.

5. The paint circulation system according to claim 1, wherein the supply pump is driven to cause the high-pressure state to occur when supplying paint to the painting device, and to cause the high-pressure state and the low-pressure state to occur during sedimentation control which prevents sedimentation when not supplying paint to the painting device.

* * * * *